United States Patent [19]

Brown et al.

[11] 4,157,703

[45] Jun. 12, 1979

[54] TOY GUN

[75] Inventors: Gary W. Brown, Huntington Beach; Jimmie L. Whittington, Diamond Bar; Douglas A. Geller, Monrovia, all of Calif.

[73] Assignee: WHAM-O Mfg. Co., San Gabriel, Calif.

[21] Appl. No.: 899,505

[22] Filed: Apr. 24, 1978

[51] Int. Cl.[2] ..... A63H 5/00; A63H 33/00

[52] U.S. Cl. ..... 124/55

[58] Field of Search ..... 124/55, 83; 46/1 E, 46/174, 175 R, 178, 189

[56] References Cited

U.S. PATENT DOCUMENTS

| | | | |
|---|---|---|---|
| 1,473,178 | 11/1923 | Dray | 124/55 |
| 2,614,551 | 10/1952 | Shelton | 124/55 |
| 2,725,672 | 12/1955 | Marini | 46/174 |
| 2,828,579 | 4/1958 | Schwerbel et al. | 124/55 X |
| 2,855,714 | 10/1958 | Thomas | 124/55 X |
| 2,879,759 | 3/1959 | Webb | 124/55 |
| 3,117,567 | 1/1964 | Allen | 124/55 |
| 3,342,171 | 9/1967 | Ryan et al. | 124/55 |
| 3,465,741 | 9/1969 | Daniel et al. | 124/55 |

*Primary Examiner*—Richard J. Apley

*Attorney, Agent, or Firm*—Christie, Parker & Hale

[57] ABSTRACT

An improved toy air gun is disclosed comprising a generally parabolic barrel having a muzzle opening at the truncated apex of the parabola. A handle and trigger mechanism are attached to the barrel exterior opposite the muzzle. A resilient diaphragm is mounted transversely of the barrel interior. Cocking means for grasping, stretching and locking the diaphragm rearwardly is provided on the gun. The trigger mechanism releases the diaphragm from the locked rearward stretched position to cause a puff of air to issue from the muzzle opening. A screen is mounted within the barrel between the muzzle opening and the diaphragm. An auxiliary cone is circumferentially attached by mounting ribs about the muzzle opening. The anterior end of the auxiliary cone has an opening of a diameter about equal to the muzzle opening. The auxiliary cone provides a circumferential opening around the muzzle having an area about equal to the area of the muzzle opening.

19 Claims, 6 Drawing Figures

TOY GUN

BACKGROUND OF THE INVENTION

The present invention relates to an improvement in a toy air gun which is safe for use by children and is capable of striking targets with a puff of air at a distance with sufficient force to indicate that the targets have been hit. There is a wide variety of toy guns of the toy market. Included in this variety are toy guns which are simply models of guns, guns which produce sound by the use of caps, papers, clickers and other noisemaking means, and guns which are capable of projecting a missile of some type. The two types of guns first mentioned above are the most popular toy guns with parents because such toy guns provide the minimum amount of danger to children. The latter type of toy gun is generally the most popular with children because children can actually determine if an object at which they aimed has been hit.

The type of guns which shoot projectiles are not popular with parents for many reasons. A toy gun which is capable of shooting a projectile can be dangerous to children who are unaware of the inherent dangers in such a gun. A projectile shot from such a gun can strike a person with the possibility of causing severe or permanent injury. For instance, a projectile shot from a gun may strike the eye of a child and permanently impair the vision of that child. Projectiles shot from such toy guns can also bring about property damage in addition to personal injury. For example, a missile shot from a toy gun can break a window, mirror or vase. Furthermore, the projectiles may be left strewed about the house in such a manner that someone may step on one and fall thereby hurting himself. Another disadvantage of such guns is that the projectiles may be permanently lost.

There are also toy guns which shoot a puff of air as a projectile. This type of toy gun has generally been considered safer than the guns which shoot solid projectiles. Toy guns which shoot such a puff of air are described in U.S. Pat. Nos. 1,806,067 to G. J. Le Jeune; 2,534,398 to M. A. Beathan; 2,614,551 to T. M. Shelton; 2,628,450 to T. M. Shelton; 2,846,996 to J. E. Drynan; and 2,879,759 to F. E. Webb, which are incorporated herein by this reference. These guns, which project a puff of air, generally have a resilient diaphragm which is either drawn rearwardly and released or is struck with a hammer to provide the puff of air. An embodiment of a toy gun, such as disclosed in U.S. Pat. No. 2,614,551, is illustrated in FIG. 1 of the present drawings.

The force of air expelled from the toy gun is provided by a resilient diaphragm within the barrel of the gun. The diaphragm is drawn rearward in the barrel stretched and locked in such a rearward position. When the diaphragm is released it abruptly springs forward, due to its inherent resiliency, pushing air in front of it. The air pushed by the rapidly forwardly moving diaphragm is expelled from the muzzle opening of the gun. The barrel of the gun can be tapered toward the muzzle opening to provide a compression chamber within the barrel wherein the air pushed by the diaphragm is compressed from a large diameter section of the barrel to a smaller diameter section of the barrel. In this manner, the air expelled from the gun has a greater velocity than if not compressed and such compressed air forms a more concentrated force as it is expelled from the gun.

There are, however, inherent dangers in toy guns which provide such a puff of air. For example, a solid object placed into the barrel of one of the guns can come into contact with the diaphragm. Thereby, as the diaphragm is moving forward to provide the puff of air it can also be catapulting the solid object from the gun. For example, a pencil loaded into such a toy gun can be propelled from the gun with sufficient force to cause injury or damage.

Another inherent danger in the toy guns which provide a puff of air is that the guns can cause injury when the muzzle of the gun is placed up against an individual and fired. The toy guns provide the puff of air by the forward movement of the resilient diaphragm. The air forced ahead of the diaphragm is compressed within the barrel and expelled out of the muzzle opening. However, if the muzzle opening is effectively blocked, the forward moving compressed air strikes the object blocking the muzzle opening, exerting a substantial force on that object. Therefore, if a child places such a gun up against his ear or the ear of another child and fires the gun, the puff of air could severely damage the ear. Thus, although a gun which fires a puff of air appears to be safe, without proper instruction and during the normal course of children at play, such a gun can prove unsafe.

SUMMANY OF THE INVENTION

In accordance with this invention, there is disclosed an improvement in a toy air gun which is capable of hitting a target at a distance without using a solid projectile and which is safe for use by children. The toy air gun comprises a barrel having a muzzle opening at one end and a breech end. A resilient diaphragm is mounted interiorly of the barrel transversely to the longitudinal axis of the barrel. Means for grasping and stretching the diaphragm rearwardly is provided on the gun. The diaphragm is released from such a locked rearward stretched position to cause a puff of air to issue from the muzzle opening. An improvement on such a gun is a screening means which is mounted within the barrel between the muzzle opening and the diaphragm. Another improvement is a venting horn telescopically attached by mounting ribs and circumferentially spaced from the muzzle. The anterior end of the horn has an opening of a diameter about equal to the diameter of the muzzle opening. The horn provides a circumferential opening around the muzzle which opening has an area at its narrowest point about equal to the area of the muzzle opening.

The improvements in the toy air gun provide a reasonably safe toy gun for use by children in their normal play. The improved toy air gun disclosed herein comprises a toy air gun which provides a force of air which when expelled from the gun travels substantially in a straight path from the barrel for a considerable distance retaining sufficient force to provide an indication upon striking a target that the target has been hit. The force of air is capable of traveling about 8 to 15 feet in a straight line with such sufficient force before the air dissipates.

The improved toy air gun is safe for use by children in that it is incapable of projecting a missile with any appreciable force to bring about personal injury or property damage. The improved toy gun is also constructed in such a manner that the compressed air forced from the gun is incapable of imparting injury when the muzzle of the gun is placed directly against an individual and fired.

The improved toy air gun herein disclosed is relatively safe and harmless in its operation but still provides the enjoyment to its user of seeing if a target at which the gun has been aimed has been hit. The improved toy gun has, as the improvements, safety features of a screen positioned within the barrel for preventing solid objects from being placed in the barrel and subsequently expelled when the gun is fired, and an auxiliary cone telescopically attached to the barrel for preventing the buildup of air pressure within the barrel when the muzzle is effectively blocked.

BRIEF DESCRIPTION OF THE DRAWINGS

These and other aspects of this invention will be more fully understood by reference to the following detailed description and the accompanying drawings in which.

DETAILED DESCRIPTION OF THE INVENTION

Figure 1:
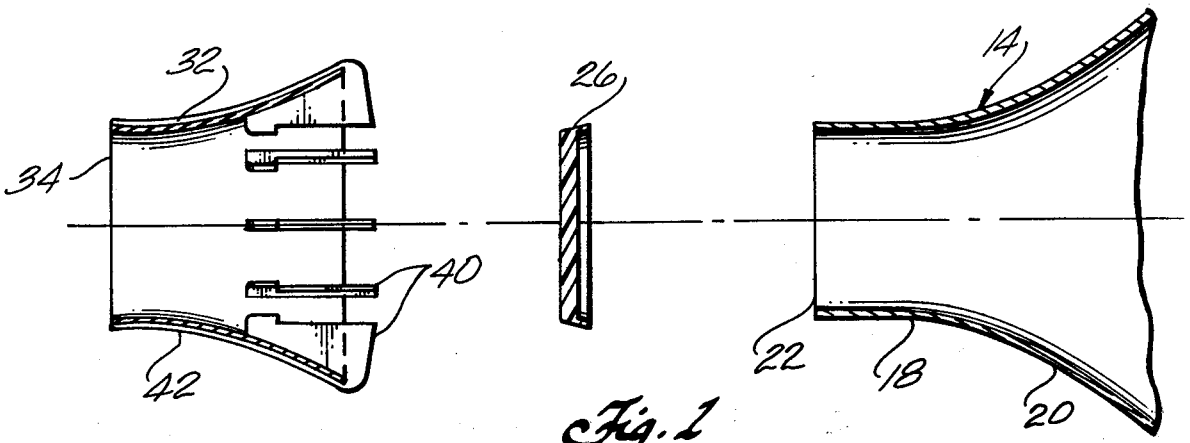
FIG. 1 is an exploded view illustrating the improvements of this invention and a barrel of an embodiment of a toy air gun.
Figure 2:
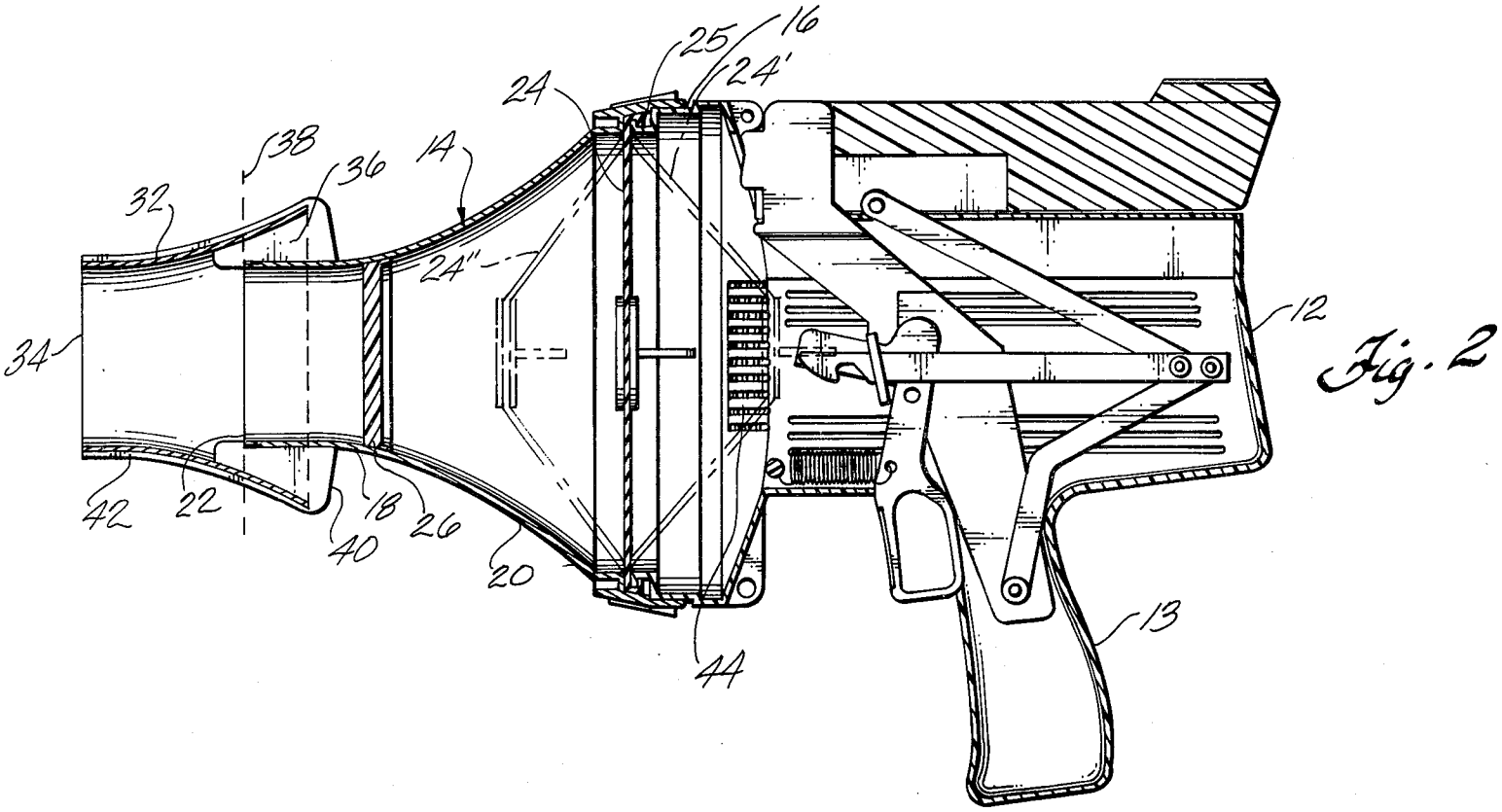
FIG. 2 is an unexploded lateral view of an embodiment of a toy air gun illustrating the improvements of this invention.
Figure 3:
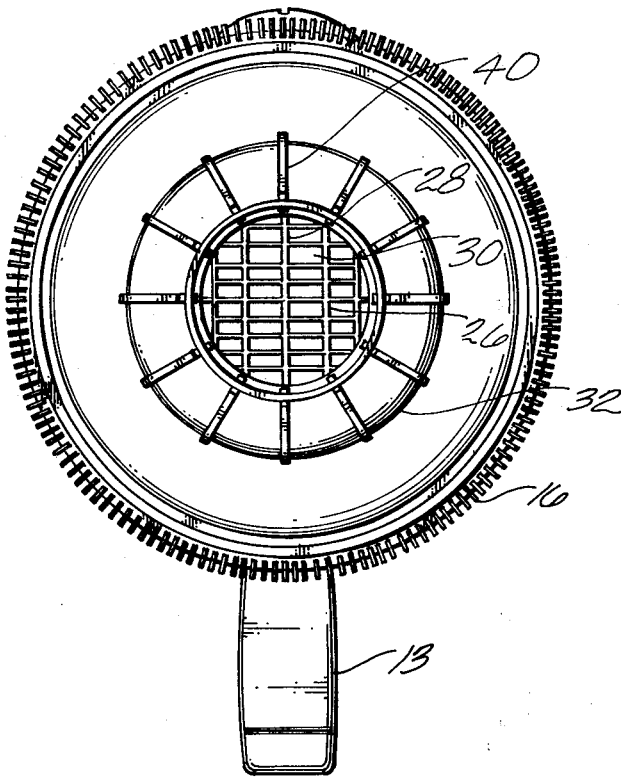
FIG. 3 is an unexploded end view looking toward the muzzle of the embodiment shown in FIG. 2.

A particular embodiment of the improvements in a toy air gun is shown in FIGS. 1, 2 and 3.

The toy air gun comprises a body 12 having attached thereto a handle 13 and a barrel 14. The barrel 14 is generally parabolic in shape with two sections; a rearward section 16 which is cylindrical and a forward section, muzzle 18, which is frusto-conical in shape. The sides of muzzle 18 can be inwardly curved along line 20. A muzzle opening 22 at the truncated apex of the parabolic barrel has a diameter substantially smaller than the diameter of the cylindrical rearward section 16 of the barrel 14.

A resilient diaphragm 24 is mounted within and transversely to the longitudinal axis of the barrel 14 between the muzzle 18 and the rearward section 16. During the course of operation of the toy air gun, the diaphragm 24 is adapted to be moved between positions 24' and 24". The positions 24' and 24" shown in FIG. 2 are referred to herein as the diaphragm rearward stretched position 24' and the diaphragm forward extended position 24". The diaphragm 24 can be made of rubber or some other similar flexible material. The diaphragm can be stretched and held in place by a ring 25 which bears outwardly against the inside wall of the cylindrical portion 16 of the barrel.

A screen 26 is mounted within the barrel 14 between the muzzle opening 22 and the forward extended position 24". It is preferred that the screen be positioned within the barrel as close as possible to the forward extended position 24" without interfering with the diaphragm 24 in such a forward extended position. Such a position is preferred to minimize interference by the screen with the compression of air which is brought about by the forward movement of the diaphragm 24. The screen 26 is, therefore, placed at a distance forward of diaphragm 24 about equal to the distance the diaphragm 24 is drawn rearward. Any object placed in the muzzle of the air gun cannot be propelled from the gun by the force of the forwardly moving diaphragm as in the prior art because the screen acts as a barrier and prevents loading a projectile, e.g., a pencil, against the diaphragm. An object loaded into the barrel must rely solely on being propelled from the gun by the force of compressed air. Generally, the force of the compressed air can pass around an object placed in the muzzle and, therefore, such an object is not propelled from the gun with any substantial force to cause injury or damage.

Figure 4:
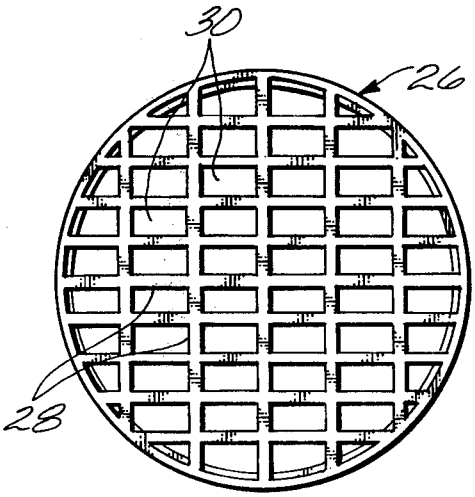
FIG. 4 is an end view of an embodiment of the screen.

The screen 26 is constructed to freely allow the passage of air therethrough but to prevent or inhibit the passage of solid particles therethrough. A frontal view of an embodiment of such a screen 26 is shown in FIG. 3 and FIG. 4. The screen 26 can be a screen, grid, grate or the like which acts as a barrier against solid particles coming into contact with the resilient diaphragm. In an embodiment of the screen 26 shown in FIG. 4 the screen 26 comprises a circular disk with solid elements 28 forming openings 30. The openings 30 are sufficiently small in size as to prevent small objects such as BB's, pencils, pebbles, etc. from passing through the screen. The ratio of the area of the openings 30 provided in the screen to the solid area represented by elements 28 is sufficiently high to minimize interference with the flow of air through the screen.

An auxiliary cone, a venting horn 32, is circumferentially and telescopically attached to the barrel 14 of the toy gun. The venting horn is attached to the muzzle 18 portion of the barrel by means of mounting ribs 40. The venting horn 32 is generally frusto-conical in shape, but the sides 42 of the venting horn can be inwardly curved to provide a generally parabolic shape. The rearward end of the venting horn 32 is of greater diameter than the anterior end. The opening 34 formed at the anterior end of the venting horn has a diameter about equal to the diameter of the muzzle opening 22. A diameter for the anterior end of the venting horn less than the diameter of the muzzle opening tends to diminish the force of the puff of compressed air expelled from the gun. A diameter of the opening of the anterior end of the venting horn greater than the diameter of the muzzle opening tends to diffuse the puff of compressed air expelled from the gun.

An opening is also provided between the sides 42 of the venting horn 32 and the muzzle 18. Such an opening 36 extends between the sides 42 of the venting horn 32 and the muzzle 18 from the forward end of the muzzle to the rearward end of the venting horn. It is preferred that the area of such an opening 36 along a plane lying along the muzzle opening 22 shown by line 38 in FIG. 2 is at least about equal to the area of the muzzle opening 22. It is also preferred that the area of the opening 36 be at least about equal to the area of the muzzle opening 22 at the point whereat the opening 36 is the most constricted. The function of the venting horn 32 is for providing an alternate pathway or vent for the compressed air expelled from the gun when the primary pathway through the muzzle opening 22 and opening 34 for such air is blocked.

When the venting horn is attached to the muzzle of the toy gun as shown in FIGS. 2 and 3, and when the toy air gun is placed up against an object substantially blocking the forward travel of the compressed air expelled from the gun, such air can reflect from the surface blocking its passage and travel rearward between the venting horn and muzzle through the opening 36 provided without encountering substantial resistance. When the area of the opening 36 in plane 38 and at the point of greatest constriction is at least about equal to the area of the muzzle opening 22, substantially little pressure is exerted on the surface blocking the forward travel of the compressed air through opening 34 of the venting horn. When the area of the opening 36 along plane 38 or at the point of greatest constriction is less than the area of the muzzle opening 22, some force is exerted by the compressed air on the surface blocking opening 34 of the venting horn. It is, therefore, preferred that the area of the opening 36 along plane 38 and the area at the point of greatest constriction be at least about equal to the area of the muzzle opening 22 in order to minimize any potential of harm in using the toy air gun.

Figure 5:
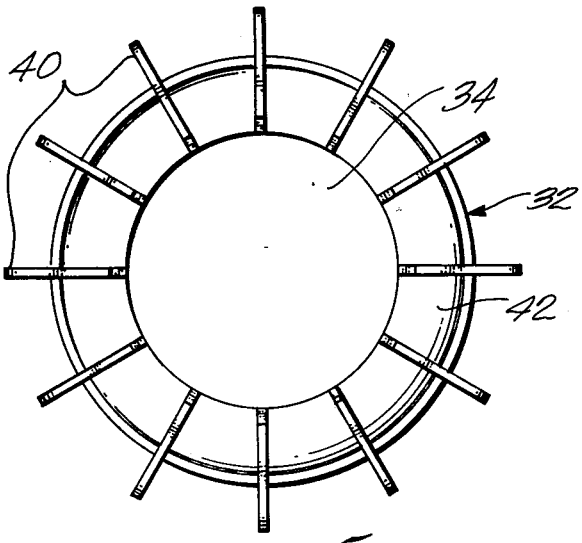
FIG. 5 is an end view of an embodiment of a venting horn.

A frontal view of the venting horn 32 is shown in FIGS. 3 and 5. The venting horn 32 is attached to the muzzle 18 by a plurality of radial ribs 40 which in combination with being supportive of the venting horn can also be decorative. The sides 42 of venting horn 32 can curve inwardly as shown in FIGS. 1 and 2 concomitantly with the sides 20 of muzzle 18, thereby enhancing any flow of air passing through opening 36 by streamlining such opening.

In order to operate the toy air gun, means are provided for drawing the diaphragm 24 rearwardly to the position 24'. Means are also provided for suddenly releasing the diaphragm such that due to its inherent resilience it snaps quickly forward to position 24''.

In the embodiment shown in FIGS. 2 and 3, the operating mechanism for drawing the diaphragm rearward and releasing it comprises a bolt which slides freely forward and rearward within the body 12 of the gun and is positioned axially with respect to the center of the diaphragm. At the forward end of the bolt is a hooked element adapted for engaging a U-shaped eyelet attached to the center of the diaphragm. A trigger is provided for releasing the diaphragm from engagement with the hooked element on the bolt.

It is significant to note that the cylindrical portion 16 of the barrel 14 is provided with ample ventilating louvers 44 which permit an ample amount of air to flow in behind the diaphragm so that there is no tendency of a vacuum to be formed to inhibit the maximum amount of forward spring when the diaphragm is released.

Figure 6:
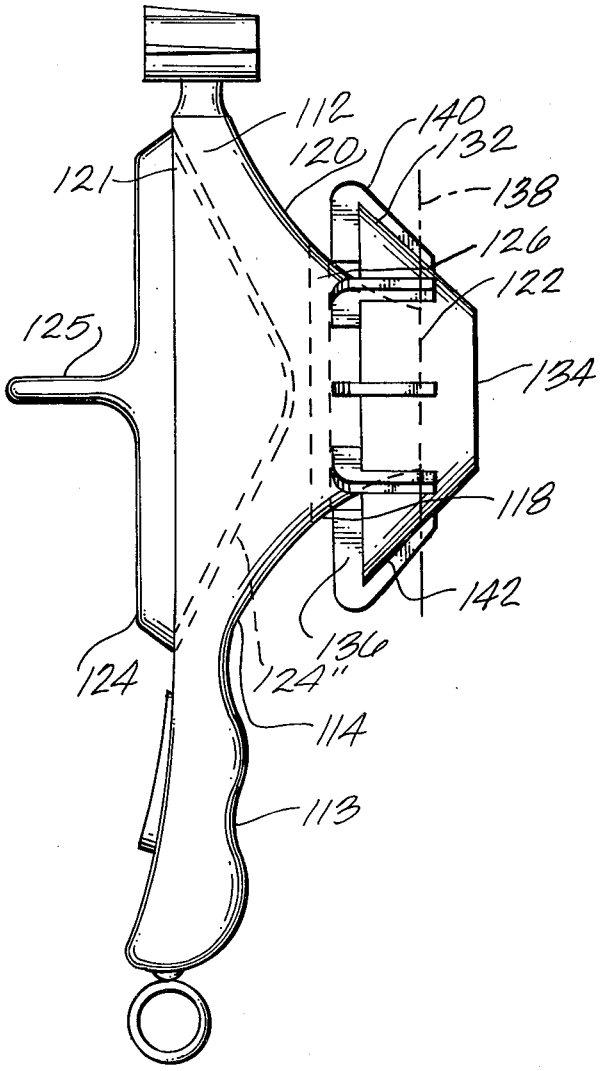
FIG. 6 is a lateral view partially in section of the improvements of this invention on another embodiment of a toy gun.

In FIG. 6 another embodiment of the improvements in a toy air gun are shown. The toy air gun illustrated in FIG. 6 comprises a body 112 having a handle 113 and a barrel 114. The barrel 114 is frusto-conical in shape, open at the smaller muzzle end 118 and enclosed at the breech end with a resilient diaphragm 124. The breech 121 has a substantially greater diameter than the muzzle opening 122. The sides of the barrel 114 can be inwardly curved as shown in the embodiment along line 120 providing a generally parabolic shaped barrel.

The resilient diaphragm 124 is circumferentially secured to the breech 121. The diaphragm is adapted with an element 125 for drawing the diaphragm rearwardly. Such an element 125 can be a protuberance of the diaphragm itself such as shown or an element attached to the diaphragm (not shown). The element 125 is preferably positioned in the center of the diaphragm to facilitate drawing of the diaphragm rearwardly.

A screen 126 is positioned within the barrel 114 as near the breech 121 as possible without interfering with the forward movement of the diaphragm 124, which depending on the distance it is drawn rearwardly, will not generally advance forward beyond the position shown as 124''. Positioning the screen 126 as far as possible rearward in the barrel minimizes any interference by the screen with the compression of air. The screen 126, as earlier described in regard to the embodiment shown in FIGS. 2 and 3, provides sufficient air flow therethrough and concomitantly provides a barrier inhibiting solid objects from coming into contact with the diaphragm as it springs abruptly forward.

Circumferentially attached to the muzzle 118 of the barrel 114 is a venting horn 132. The rearward end of the venting horn 132 is of greater diameter than the anterior end. The opening 134 formed at the anterior end of the venting horn has a diameter about equal to the diameter of the muzzle opening 122. Such a size for an opening 134 provides substantially little interference with the air expelled from the toy gun. The venting horn 132 is telescopically attached to the muzzle 118 by a plurality of radial ribs 140 as disclosed earlier with reference to the embodiment shown in FIG. 2. An opening 136 is provided between the sides 142 of the venting horn 132 and the sides 120 of the barrel. Such an opening 136 has an area in plane 138 at least about equal to the area of the muzzle opening 122. With such an area in plane 138, the opening 136 provides an alternate pathway or vent for any air expelled from the gun when the primary pathway directly forward is substantially blocked.

The embodiment of the toy gun shown in FIG. 6 is operated by drawing the diaphragm 124 rearwardly by means of the element 125. When the diaphragm has been drawn sufficiently rearward, the element 125 is released allowing the diaphragm to abruptly spring forward forcing air ahead of it outwardly of the muzzle 114 of the barrel. The air forced out of the gun continues generally in a straight pathway with sufficient force for a substantial distance to strike a target adapted to indicate that it had been hit. If, however, the opening 134 is blocked, the air expelled from the gun encounters such blockage and reflects rearwardly through the opening 136 without exerting any appreciable amount of force on the object blocking the opening 136. The sides 142 of the venting horn can be contoured to the contour of the muzzle and barrel to streamline the opening 136 for enhancing the air flow through the opening. In FIG. 6 both the sides 120 of the barrel and sides 142 of the venting horn are inwardly curved providing a generally parabolic shape to the barrel and venting horn for enhancing the air flow through opening 136.

Although the invention has been herein shown and described in what is conceived to be the most practical and preferred embodiments, it is recognized that departures may be made therefrom within the scope of the invention, which is not intended to be limited to the details disclosed herein but is to be accorded the full scope of the claims so as to embrace any and all equivalent structures.

What is claimed:

1. An improved toy gun comprising:

(a) a barrel having a muzzle opening at one end and a breech end;

(b) a resilient diaphragm mounted interiorly of the barrel and extending transversely of the longitudinal axis of the barrel;

(c) means for grasping and stretching the diaphragm rearwardly;

(d) screening means mounted within the barrel between the muzzle opening and the diaphragm; and (e) a frusto-conically shaped venting horn having its base end telescopically attached and circumferentially spaced from the muzzle, the spacing of the horn providing an opening between the horn and the barrel having an area at the point of greatest constriction approximately equal to the area of the muzzle opening.

2. A toy air gun as claimed in claim 1 wherein the anterior end of the horn has a diameter approximately equal to the diameter of the muzzle opening.

3. A toy air gun as claimed in claim 1 wherein said screening means prevents solid objects placed within the barrel from contacting the diaphragm.

4. A toy air gun as claimed in claim 1 wherein said screening means inhibits solid objects placed within the barrel from contacting the diaphragm while providing substantially uninhibited air flow through the barrel.

5. A toy air gun as claimed in claim 1 wherein said screening means is mounted within the barrel forward of the diaphragm at a distance from the diaphragm about equal to the distance between the diaphragm and the rearward diaphragm stretched position.

6. A toy air gun as claimed in claim 1 wherein said barrel has inwardly curved walls between ends and said venting horn has inwardly curved walls corresponding with the curvature of the walls of the barrel.

7. A toy gun as claimed in claim 1 wherein the barrel is parabolic and has a muzzle opening substantially smaller in diameter than the breech end.

8. A toy gun as claimed in claim 7 wherein the frusto-conically shaped horn has inwardly curved sides providing a parabolic shape to the horn.

9. A toy gun as claimed in claim 1 wherein the point of greatest constriction of the opening is in an extended plane formed by the muzzle opening.

10. In a toy gun having a parabolic barrel with a muzzle opening substantially smaller in diameter than the end opposite therefrom, a resilient diaphragm mounted interiorly of the barrel and extending transversely of the longitudinal axis of the barrel, means for grasping and stretching the diaphragm rearwardly, and means for releasing the diaphragm from such a rearward diaphragm stretched position for providing a sudden compression of air which is expelled from the muzzle, an improvement comprising a screen mounted within the barrel between the muzzle opening and the diaphragm.

11. A toy gun as claimed in claim 10 wherein said screen prevents solid objects placed within the barrel from contacting the diaphragm.

12. A toy gun as claimed in claim 10 wherein said screen prevents solid objects of significant size placed within the barrel from contacting the diaphragm while providing substantially unhibited air flow through the barrel.

13. A toy air gun as claimed in claim 10 wherein said screen is mounted within the barrel forward of the diaphragm at a distance from the diaphragm about equal to the distance between the diaphragm and the rearward diaphragm stretched position.

14. In a toy gun having a parabolic barrel with a muzzle opening substantially smaller in diameter than the end opposite therefrom, a resilient diaphragm mounted interiorly of the barrel and extending transversely of the longitudinal axis of the barrel, means for grasping and stretching the diaphragm rearwardly, and means for releasing the diaphragm from such a rearward diaphragm stretched position for providing a sudden compression of air which is expelled from the muzzle opening an improvement comprising a frusto-conically shaped horn having its base end telescopically attached and circumferentially spaced from the muzzle, the spacing of the horn providing an opening between the horn and barrel having an area at the point of greatest constriction approximately equal to the area of the muzzle opening.

15. A toy gun as claimed in claim 14 wherein the anterior end of the horn has a diameter approximately equal to the diameter of the muzzle opening.

16. A toy gun as claimed in claim 14 wherein the opening provided between the horn and the barrel has a point of greatest constriction in an extended plane formed by the muzzle opening.

17. A toy gun as claimed in claim 14 further comprising screening means mounted within the barrel between the muzzle opening and the diaphragm.

18. A toy gun as claimed in claim 17 wherein said screening means prevents solid objects of significant size placed within the barrel from contacting the diaphragm while providing substantially uninhibited air flow through the barrel.

19. A toy gun as claimed in claim 17 wherein said screening means is mounted within the barrel forward of the diaphragm at a distance from the diaphragm about equal to the distance between the diaphragm and the rearward diaphragm stretching position.

* * * * *